US011618070B2

(12) United States Patent
Kajimoto

(10) Patent No.: US 11,618,070 B2
(45) Date of Patent: Apr. 4, 2023

(54) MOLD AND FORGING METHOD

(71) Applicant: TOYOTA JIDOSHA KABUSHIKI KAISHA, Toyota (JP)

(72) Inventor: Tetsuya Kajimoto, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/492,964

(22) Filed: Oct. 4, 2021

(65) Prior Publication Data

US 2022/0168800 A1 Jun. 2, 2022

(30) Foreign Application Priority Data

Dec. 1, 2020 (JP) ..... JP2020-199310

(51) Int. Cl.

| | |
|---|---|
| ***B21J 5/00*** | (2006.01) |
| ***B21J 5/02*** | (2006.01) |
| ***B21J 13/02*** | (2006.01) |
| ***B21J 1/04*** | (2006.01) |

(52) U.S. Cl.

CPC . *B21J 5/02* (2013.01); *B21J 1/04* (2013.01); *B21J 13/02* (2013.01)

(58) Field of Classification Search

CPC ..... B21J 1/04; B21J 1/06; B21J 5/02; B21J 5/025; B21J 5/08; B21J 9/02; B21J 9/06; B21J 13/02

See application file for complete search history.

(56) References Cited

U.S. PATENT DOCUMENTS

2004/0255637 A1* 12/2004 Dohmann ..... B21J 1/04 72/354.2

FOREIGN PATENT DOCUMENTS

JP 2004-122163 A 4/2004

* cited by examiner

*Primary Examiner* — Debra M Sullivan
(74) *Attorney, Agent, or Firm* — Sughrue Mion, PLLC

(57) ABSTRACT

A mold of the present disclosure is used when forging a billet having a rod shape, and the mold includes: a lower mold having a groove portion for housing the billet; an upper mold having a pressing portion engaged with the groove portion and that presses the billet; and a guide portion disposed in the groove portion or the pressing portion and that guides a flow of a material of the billet in a longitudinal direction of the billet. In a state in which the groove portion and the pressing portion are engaged, in a direction in which the groove portion extends, a protruding amount of a top portion of the guide portion to an inner side of the groove portion is larger than a protruding amount of end portions on both sides sandwiching the top portion of the guide portion to the inner side of the groove portion.

8 Claims, 10 Drawing Sheets

MOLD AND FORGING METHOD

CROSS-REFERENCE TO RELATED APPLICATION

This application claims priority to Japanese Patent Application No. 2020-199310 filed on Dec. 1, 2020, incorporated herein by reference in its entirety.

BACKGROUND

1. Technical Field

The present disclosure relates to a mold and forging method, and relates to a mold and forging method used, for example, when forging a rod-shaped billet.

2. Description of Related Art

When a product longer and thinner than a rod-shaped billet (for example, the connecting rod body of an automobile) is formed from the billet by forging, preforming is performed in order to improve the yield.

For example, in the forging method of Japanese Unexamined Patent Application Publication No. 2004-122163 (JP 2004-122163 A), by sandwiching a billet with a lower pre-molding mold that is vertically drivingly inserted into a through hole of a lower holding plate and an upper pre-molding mold that is vertically drivingly inserted into a through hole of an upper holding plate, pre-molding is performed in which the billet is extended in the longitudinal direction while an arc-shaped thin wall portion protruding in the left-right direction of the billet is formed.

SUMMARY

The applicant has found the following issues. In the forging method of JP 2004-122163 A, when the billet is extended in the longitudinal direction, a thin wall portion protruding in a left-right direction is formed. Thus, the material of the billet flows in the left-right direction by just a protruding amount in the left-right direction from the billet and the billet cannot be extended efficiently in the longitudinal direction.

The present disclosure has been made in view of such problems, and realizes a mold and a forging method capable of efficiently extending a billet in a longitudinal direction.

The mold according to one aspect of the present disclosure is a mold used when forging a billet having a rod shape, and the mold includes:

a lower mold having a groove portion for housing the billet;

an upper mold having a pressing portion that is engaged with the groove portion and that presses the billet; and a guide portion that is disposed in the groove portion or the pressing portion and that guides a flow of a material of the billet in a longitudinal direction of the billet, in which in a state in which the groove portion and the pressing portion are engaged, in a direction in which the groove portion extends, a protruding amount of a top portion of the guide portion to an inner side of the groove portion is larger than a protruding amount of end portions on both sides sandwiching the top portion of the guide portion to the inner side of the groove portion.

In the above mold, it is preferable that the guide portion be disposed at a lower end portion of the pressing portion, and have a curved shape with a shape protruding toward a lower side of the mold, when viewed in a direction orthogonal to the direction in which the groove portion extends in the state in which the pressing portion is engaged with the groove portion and a vertical direction of the mold.

Regarding the above mold, it is preferable that the guide portion be disposed on a side portion or a bottom portion of the groove portion, and have a curved shape with a shape protruding inward of the groove portion, when viewed in a direction orthogonal to the direction in which the groove portion extends.

It is preferable that the above mold include support portions that are disposed on both sides sandwiching the guide portion disposed on the bottom portion of the groove portion so as to be movable in a vertical direction of the mold, and that supports the billet housed in the groove portion.

In the above mold, it is preferable that the support portions be supported by elastic members that expand and contract in the vertical direction of the mold.

It is preferable that the above mold include a restricting portion that is disposed in the pressing portion and that restricts a flow of the material of the billet in a transverse direction of the billet, and in the state in which the groove portion and the pressing portion are engaged, in the direction orthogonal to the direction in which the groove portion extends and the vertical direction of the mold, a protruding amount of both end portions of the restricting portion to a lower side of the mold be larger than a protruding amount of a top portion between the both end portions of the restricting portion to the lower side of the mold.

In the above mold, it is preferable that the restricting portion have a curved shape with a shape protruding toward an upper side of the mold, when viewed in the direction in which the groove portion extends in the state in which the pressing portion is engaged with the groove portion.

A forging method according to one aspect of the present disclosure is a method of forging a billet having a rod shape, and the method includes:

a step of housing the billet in a groove portion of a lower mold; and a step of pressing the billet with a pressing portion of an upper mold and engaging the pressing portion to the groove portion;

in which a flow of material of the billet to a longitudinal direction of the billet is guided toward both end portions of the billet by a guide portion disposed in the groove portion or the pressing portion, when the billet is pressed.

In the above forging method, it is preferable that when the billet is pressed, the restricting portion that is disposed in the pressing portion restrict the flow of the material of the billet in a transverse direction of the billet.

In the above forging method, it is preferable that when the billet is pressed, portions on both sides of the billet sandwiching the guide portion be supported by support portions.

The present disclosure realizes a mold and a forging method capable of efficiently extending a billet in a longitudinal direction.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, specific embodiments to which the present disclosure is applied will be described in detail with reference to the drawings. However, the present disclosure is not limited to the following embodiments. The following description and drawings are simplified as appropriate for the sake of clarity.

First Embodiment

First, the configuration of a mold according to the present embodiment will be described. The mold of the present embodiment is suitable for pre-molding that is performed when a product longer and thinner than a billet is formed from rod-shaped billet by forging. In the following description, in order to clarify the description, a three-dimensional (XYZ) coordinate system will be used. Here, the Z-axis plus side is the upper side of the mold, and the Z-axis minus side is the lower side of the mold.

Figure 1:
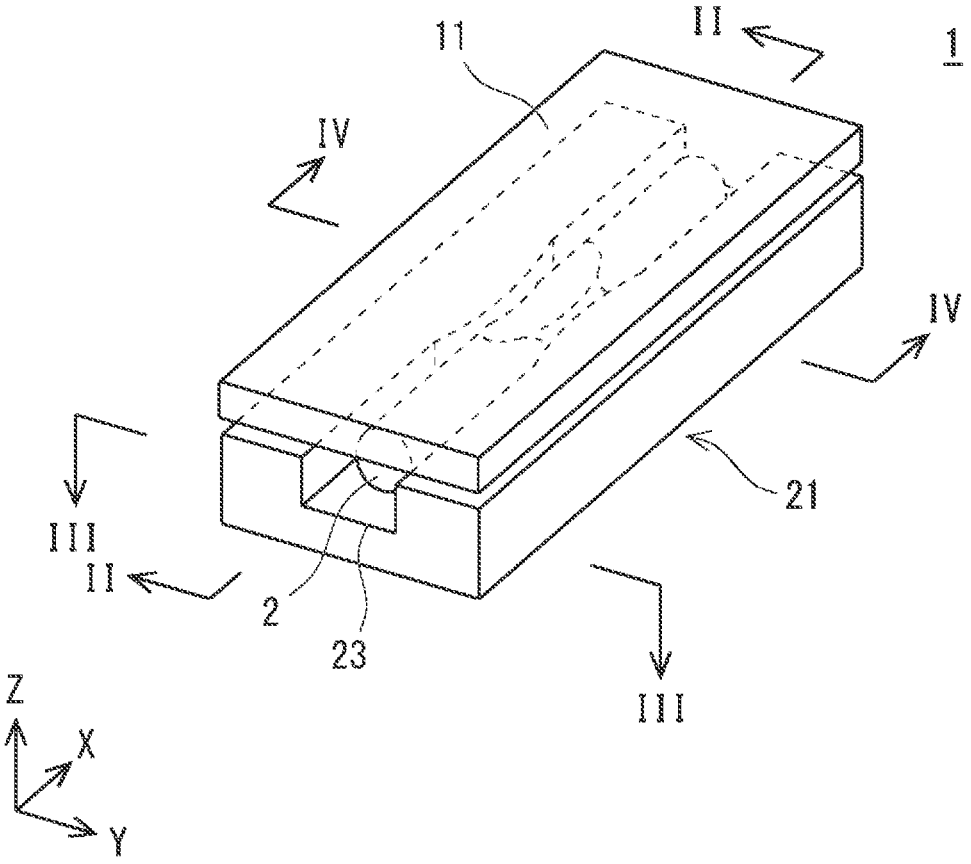
FIG. 1 is a perspective view schematically showing a state in which a billet is forged using a mold of a first embodiment.
Figure 2:
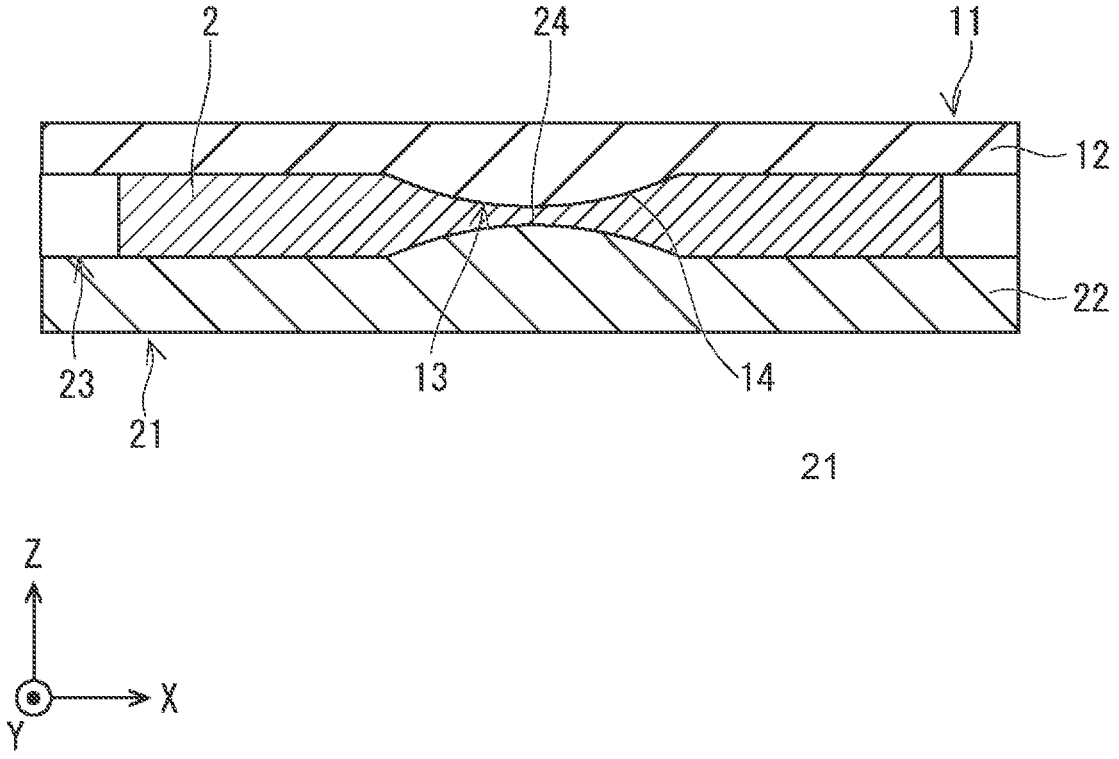
FIG. 2 is a cross-sectional view taken along line II-II in FIG. 1.
Figure 3:
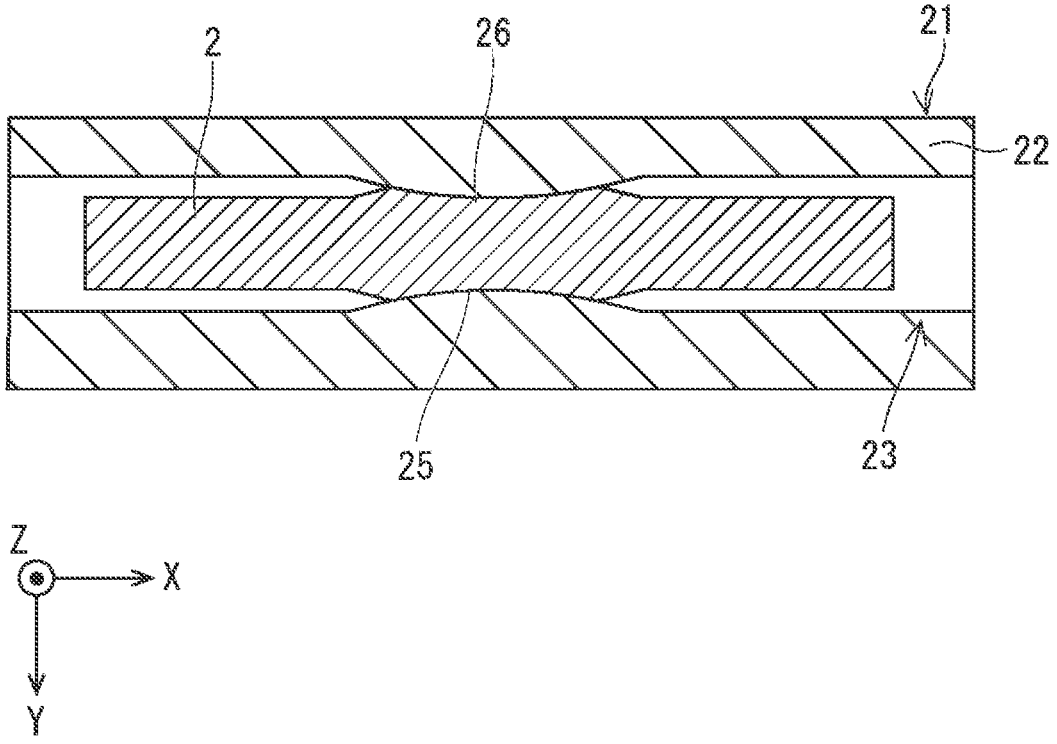
FIG. 3 is a cross-sectional view taken along line III-III in FIG. 1.
Figure 4:
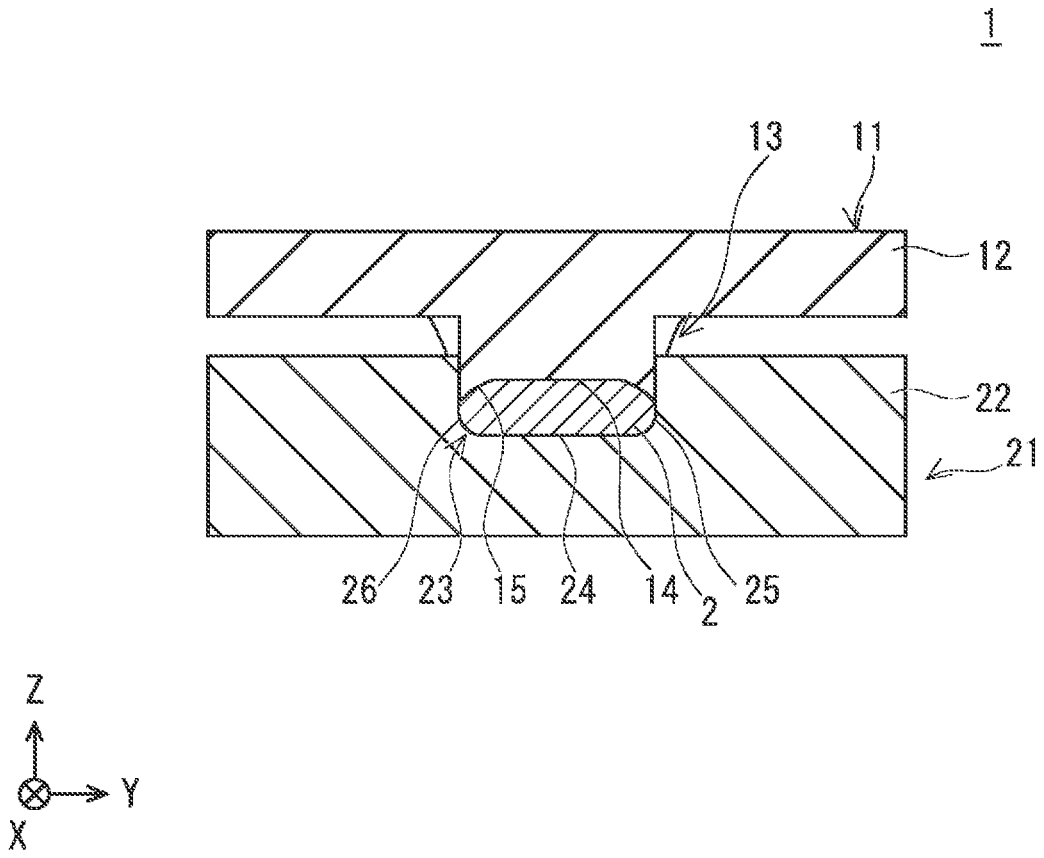
FIG. 4 is a cross-sectional view taken along line IV-IV in FIG. 1.
Figure 5:
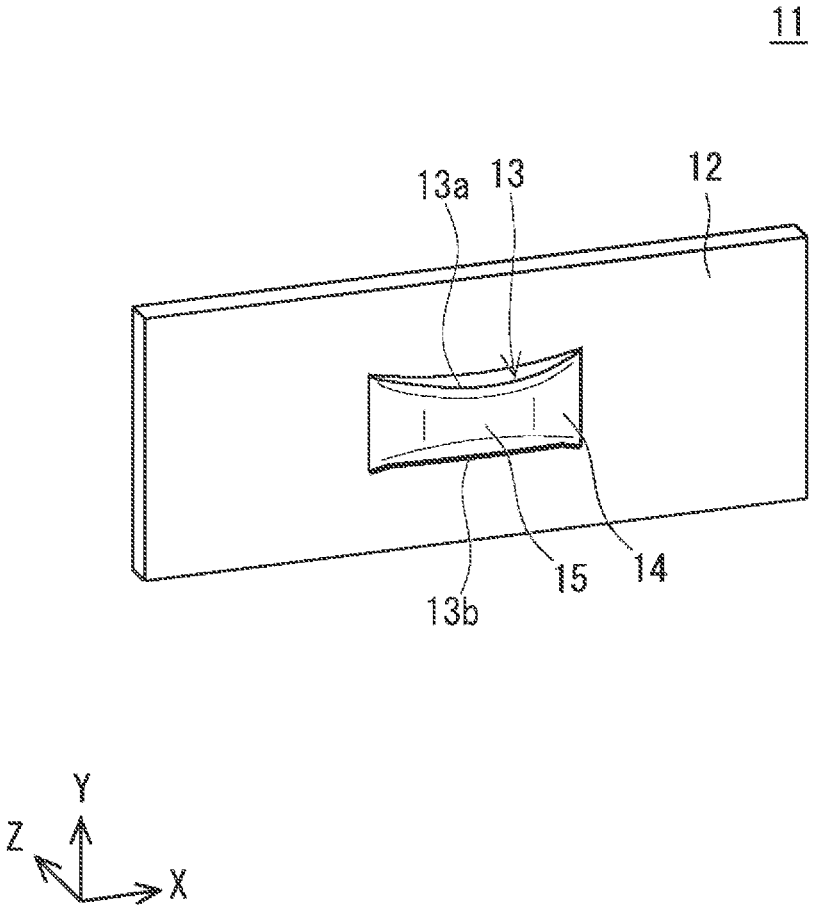
FIG. 5 is a perspective view of an upper mold of the mold of the first embodiment as viewed from a Z-axis minus side.
Figure 6:
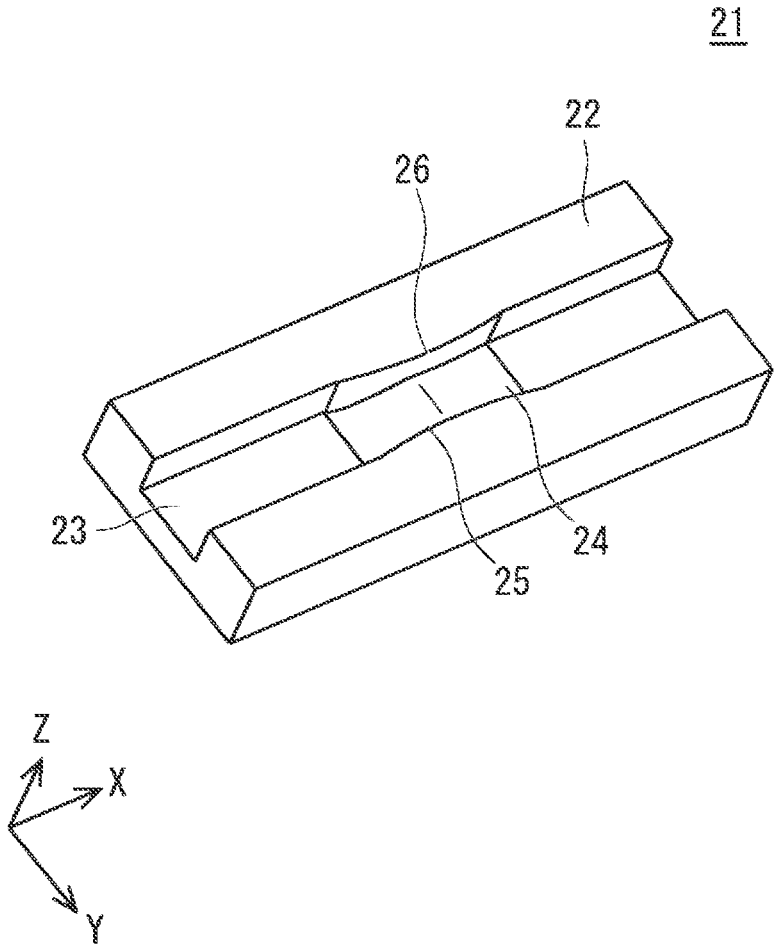
FIG. 6 is a perspective view of a lower mold of the mold of the first embodiment as viewed from a Z-axis plus side.

FIG. 1 is a perspective view schematically showing a state in which a billet is forged using a mold of the present embodiment. FIG. 2 is a cross-sectional view taken along line II-II in FIG. 1. FIG. 3 is a cross-sectional view taken along line III-III in FIG. 1. FIG. 4 is a cross-sectional view taken along line IV-IV in FIG. 1. FIG. 5 is a perspective view of the upper mold of the mold of the first embodiment as viewed in the Z-axis minus side. FIG. 6 is a perspective view of the lower mold of the mold of the first embodiment as viewed in the Z-axis plus side.

As shown in FIG. 1 to FIG. 4, a mold 1 includes an upper mold 11 and a lower mold 21. As shown in FIG. 4 and FIG. 5, the upper mold 11 includes a holding portion 12, a pressing portion 13, a guide portion 14, and a restricting portion 15. The holding portion 12 is, for example, a rectangular plate that has a side parallel to the X-axis and a side parallel to the Y-axis, and has a longitudinal direction in the X-axis direction.

The pressing portion 13 presses a billet 2 when the billet 2 is forged. The details will be described later. The pressing portion 13 protrudes from the holding portion 12 to the Z-axis minus side. The pressing portion 13 has, for example, a rectangular shape when viewed in the Z-axis direction, and is disposed at the substantial center of the holding portion 12.

Specifically, as shown in FIG. 5, the pressing portion 13 includes a side extending in the X-axis direction and a side extending in the Y-axis direction when viewed in the Z-axis direction. Here, a side 13*a* that extends in the X-axis direction and that is disposed on the Y-axis plus side has a curved shape with a shape protruding toward the Y-axis minus side so as to correspond to a second guide portion 25 disposed in a groove portion 23 of a lower mold 21.

Further, a side 13*b* that extends in the X-axis direction and that is disposed on the Y-axis minus side has a curved shape protruding to the Y-axis plus side so as to correspond to a third guide portion 26 disposed in the groove portion 23 of the lower mold 21. However, the pressing portion 13 may have a shape and disposition in which the pressing portion 13 can be engaged with the groove portion 23 of the lower mold 21 as described later.

Although the details will be described later, the guide portion 14 guides the flow of the material of the billet 2 in the longitudinal direction of the billet 2. As shown in FIG. 4 and FIG. 5, the guide portion 14 is disposed at an end portion on the Z-axis minus side of the pressing portion 13.

When viewed in the Y-axis direction, the guide portion 14 has shape in which a protruding amount of a top portion in the X-axis direction of the guide portion 14, in which the top portion protrudes from the holding portion 12 to the Z-axis minus side, is larger than a protruding amount of end portions on both sides sandwiching the top portion of the guide portion 14 in the X-axis direction, in which the end portions protrude from the holding portion 12 to the Z-axis minus side. The guide portion 14 may have, for example, a curved shape with a shape protruding toward the Z-axis minus side when viewed in the Y-axis direction.

Although the details will be described later, the restricting portion 15 restricts the flow of the material of the billet 2 in a transverse direction of the billet 2. As shown in FIG. 4 and FIG. 5, the restricting portion 15 is disposed at the end portion on the Z-axis minus side of the pressing portion.

When viewed in the X-axis direction, the restricting portion 15 has shape in which a protruding amount on both sides of the restricting portion 15 in the Y-axis direction, in which both sides protrude from the holding portion 12 to the Z-axis minus side, is larger than a protruding amount of a top portion between both end portions of the restricting portion 15 in the Y-axis direction, in which the top portion protrudes from the holding portion 12 to the Z-axis minus side.

Specifically, the restricting portion 15 preferably has a curved shape with a shape protruding toward the Z-axis plus side when viewed in the X-axis direction. As described above, the end portion of the pressing portion 13 on the Z-axis plus side has a three-dimensional shape in which the guide portion 14 and the restricting portion 15 are disposed.

As shown in FIG. 6, the lower mold 21 includes a base portion 22, the groove portion 23, a first guide portion 24, the second guide portion 25, and the third guide portion 26. The base portion 22 is, for example, a rectangular block body having a side parallel to the X-axis and a side parallel to the Y-axis, and extends in the X-axis direction. A peripheral edge portion of the base portion 22 substantially coincides with a peripheral edge portion of the holding portion 12 in a state where the upper mold 11 and the lower mold 21 are overlapped in the Z-axis direction, for example.

As shown in FIG. 1, the groove portion 23 houses the billet 2 when forging the billet 2. The groove portion 23 is disposed at the end portion of the base portion 22 on the Z-axis plus side, and extends in the X-axis direction. The groove portion 23 has, for example, a substantially rectangular pillar shape when viewed in the X-axis direction as a basic form. However, the groove portion 23 may have a shape capable of housing substantially the entire area of the billet 2 in the Z-axis direction when forging the billet 2.

The first guide portion 24, the second guide portion 25, and the third guide portion 26 guide the flow of the material of the billet 2 in the longitudinal direction of the billet 2, and the details will be described later. As shown in FIG. 2 and FIG. 6, the first guide portion 24 is disposed at a bottom portion of the groove portion 23, and is disposed so as to face the guide portion 14 of the upper mold 11 in the Z-axis direction, in a state in which the pressing portion 13 of the upper mold 11 is engaged with the groove portion 23 of the lower mold 21.

When viewed in the Y-axis direction, the first guide portion 24 has shape in which a protruding amount of a top portion in the X-axis direction of the first guide portion 24, in which the top portion protrudes from a bottom portion of the groove portion 23 to the Z-axis plus side, is larger than a protruding amount of end portions on both sides sandwiching the top portion of the first guide portion 24 in the X-axis direction, in which the end portions protrude from the bottom portion of the groove portion 23 to the Z-axis plus side. The first guide portion 24 may have, for example, a curved shape with a shape protruding toward the Z-axis plus side when viewed in the Y-axis direction. At this time, the first guide portion 24 may have a shape substantially equal to that of the guide portion 14 of the upper mold 11.

As shown in FIG. 3 and FIG. 6, the second guide portion 25 is disposed on a side wall portion on the Y-axis plus side of the groove portion 23, and is disposed at a position substantially equal to the first guide portion 24 when viewed in the Y-axis direction. When viewed in the Z-axis direction, the second guide portion 25 has shape in which a protruding amount of a top portion of the second guide portion 25 in the X-axis direction, in which the top portion protrudes from the side wall portion on the Y-axis plus side of the groove portion 23 to the Y-axis minus side, is larger than a protruding amount of end portions on both sides sandwiching the top portion of the second guide portion 25 in the X-axis direction, in which the end portions protrude from the side wall portion on the Y-axis plus side of the groove portion 23 to the Y-axis minus side. The second guide portion 25 may have, for example, a curved shape with a shape protruding toward the Y-axis minus side when viewed in the Z-axis direction.

As shown in FIG. 3 and FIG. 6, the third guide portion 26 is disposed on the side wall portion on the Y-axis minus side of the groove portion 23 and is disposed so as to face the second guide portion 25 when viewed in the Z-axis direction. When viewed in the Z-axis direction, the third guide portion 26 has shape in which a protruding amount of a top portion of the third guide portion 26 in the X-axis direction, in which the top portion protrudes from the side wall portion on the Y-axis minus side of the groove portion 23 to the Y-axis plus side, is larger than a protruding amount of end portions on both sides sandwiching the top portion of the third guide portion 26 in the X-axis direction, in which the end portions protrude from the side wall portion on the Y-axis minus side of the groove portion 23 to the Y-axis plus side. The third guide portion 26 may have, for example, a curved shape with a shape protruding toward the Y-axis plus side when viewed in the Z-axis direction. At this time, the third guide portion 26 may have a shape substantially equal to that of the second guide portion 25.

Next, the flow of forging the billet 2 by using the mold 1 of the present embodiment will be described. First, the billet 2 is housed in the groove portion 23 of the lower mold 21. Then, the upper mold 11 is disposed on the Z-axis plus side of the lower mold 21 so that the guide portion 14 of the upper mold 11 and the first guide portion 24 of the lower mold 21 face each other in the Z-axis direction.

Next, when the upper mold 11 is moved to the Z-axis minus side and the billet 2 is pressed by the pressing portion 13 of the upper mold 11 while the pressing portion 13 is engaged with the groove portion 23 of the lower mold 21, the billet 2 can be forged. At this time, since the billet 2 is housed in the groove portion 23 of the lower mold 21, the flow of the material of the billet 2 in the Y-axis direction is suppressed, and flows along the X-axis direction in which the groove portion 23 extends, that is, the longitudinal direction of the billet 2.

Moreover, when viewed in the Y-axis direction, the guide portion 14 of the upper mold 11 has shape in which the protruding amount of the top portion in the X-axis direction of the guide portion 14, in which the top portion protrudes from the holding portion 12 to the Z-axis minus side, is larger than the protruding amount of the end portions on both sides sandwiching the top portion of the guide portion 14 in the X-axis direction, in which the end portions protrude from the holding portion 12 to the Z-axis minus side.

Further, when viewed in the Y-axis direction, the first guide portion 24 of the lower mold 21 has shape in which the protruding amount of the top portion in the X-axis direction of the first guide portion 24, in which the top portion protrudes from the bottom portion of the groove portion 23 to the Z-axis plus side, is larger than the protruding amount of the end portions on both sides sandwiching the top portion of the first guide portion 24 in the X-axis direction, in which the end portions protrude from the bottom portion of the groove portion 23 to the Z-axis plus side.

Therefore, the material of the portion of the billet 2 pressed by the pressing portion 13 of the upper mold 11 flows outside the groove portion 23, with the top portion of the guide portion 14 of the upper mold 11 in the X-axis direction and the top portion of the first guide portion 24 of the lower mold 21 in the X-axis direction serving as a boundary, in the X-axis direction.

That is, in the billet 2, the material of the portion on the X-axis plus side with respect to the top portion of the guide portion 14 of the upper mold 11 in the X-axis direction and the top portion of the first guide portion 24 of the lower mold 21 in the X-axis direction flows to the X-axis plus side. Further, in the billet 2, the material of the portion on the X-axis minus side with respect to the top portion of the guide portion 14 of the upper mold 11 in the X-axis direction and the top portion of the first guide portion 24 of the lower mold 21 in the X-axis direction flows to the X-axis minus side.

When viewed in the Z-axis direction, the second guide portion 25 of the lower mold 21 has shape in which the protruding amount of the top portion of the second guide portion 25 in the X-axis direction, in which the top portion protrudes from the side wall portion on the Y-axis plus side of the groove portion 23 to the Y-axis minus side, is larger than the protruding amount of the end portions on both sides sandwiching the top portion of the second guide portion 25 in the X-axis direction, in which the end portions protrude from the side wall portion on the Y-axis plus side of the groove portion 23 to the Y-axis minus side.

When viewed in the Z-axis direction, the third guide portion 26 of the lower mold 21 has shape in which the protruding amount of the top portion of the third guide portion 26 in the X-axis direction, in which the top portion protrudes from the side wall portion on the Y-axis minus side of the groove portion 23 to the Y-axis plus side, is larger than the protruding amount of the end portions on both sides sandwiching the top portion of the third guide portion 26 in the X-axis direction, in which the end portions protrude from the side wall portion on the Y-axis minus side of the groove portion 23 to the Y-axis plus side.

Therefore, the material of the portion of the billet 2 pressed by the pressing portion 13 of the upper mold 11 flows outside the groove portion 23, with the top portion of the second guide portion 25 of the lower mold 21 in the X-axis direction and the top portion of the third guide portion 26 of the lower mold 21 in the X-axis direction serving as a boundary, in the X-axis direction.

That is, in the billet 2, the material of the portion on the X-axis plus side with respect to the top portion of the second guide portion 25 of the lower mold 21 in the X-axis direction and the top portion of the third guide portion 26 in the X-axis direction flows to the X-axis plus side. Further, in the billet 2, the material of the portion on the X-axis minus side with respect to the top portion of the second guide portion 25 of the lower mold 21 in the X-axis direction and the top portion of the third guide portion 26 in the X-axis direction flows to the X-axis minus side.

In this way, the material of the billet 2 can be flowed satisfactorily in the longitudinal direction of the billet 2 by the groove portion 23 of the lower mold 21, the guide portion 14 of the upper mold 11, the first guide portion 24 of the lower mold 21, the second guide portion 25, and the third guide portion 26.

Moreover, when the guide portion 14 of the upper mold 11 and the first guide portion 24, the second guide portion 25, and the third guide portion 26 of the lower mold 21 have a curved shape, the frictional resistance of each guide portion 14, 24, 25, 26 and the billet 2 when the billet 2 is extended can be reduced. Further, the internal pressure at an engaging portion of the pressing portion 13 of the upper mold 11 and the groove portion 23 of the lower mold 21 can be reduced.

Therefore, it is possible to suppress the material of the billet 2 from entering the gap between the pressing portion 13 and the groove portion 23, in which the gap is generated when the pressing portion 13 of the upper mold 11 and the groove portion 23 of the lower mold 21 are engaged, and as a result, the generation of burrs can be suppressed.

Figure 7:
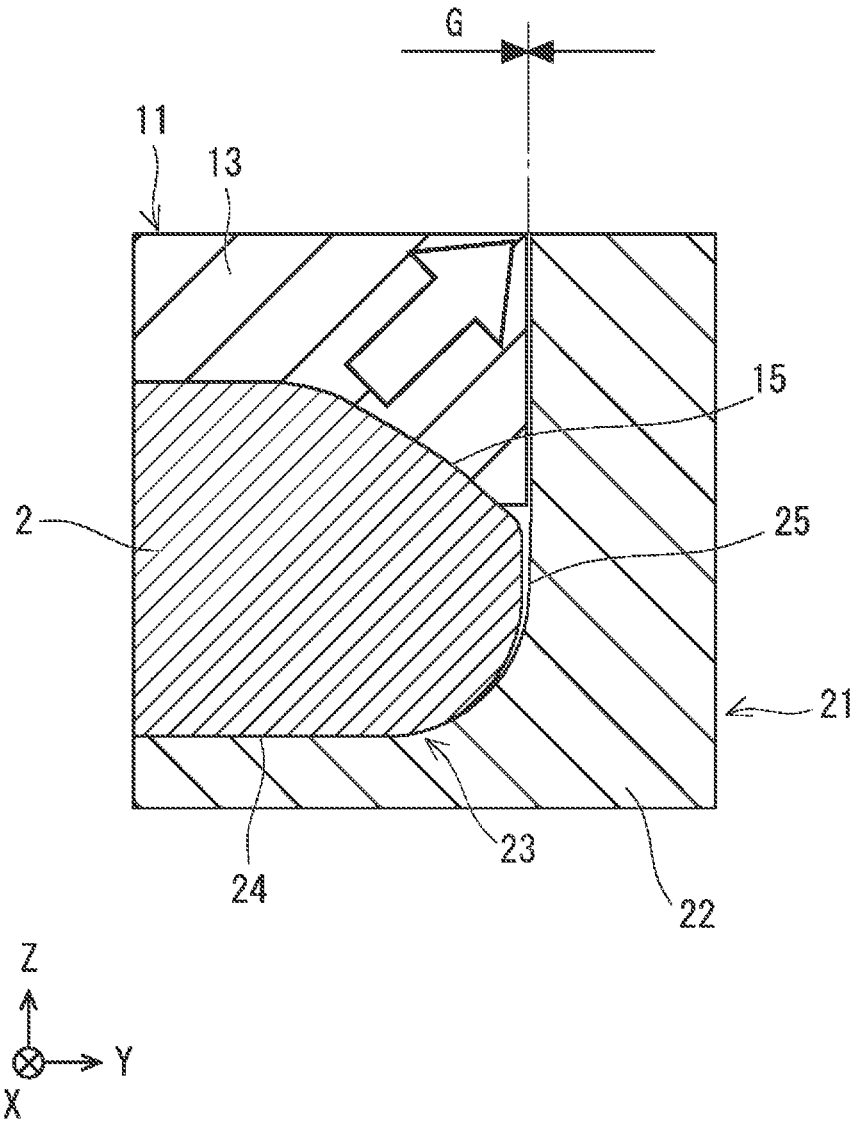
FIG. 7 is a diagram for explaining a force acting on a restricting portion from the billet when the billet is pressed.

Here, FIG. 7 is a diagram for explaining a force acting on the restricting portion from the billet when the billet is pressed. When viewed in the X-axis direction, the restricting portion 15 of the upper mold 11 has shape in which the protruding amount on both sides of the restricting portion 15 in the Y-axis direction, in which both sides protrude from the holding portion 12 to the Z-axis minus side, is larger than the protruding amount of the top portion between both end portions of the restricting portion 15 in the Y-axis direction, in which the top portion protrudes from the holding portion 12 to the Z-axis minus side.

Therefore, when the billet 2 is pressed as described above, as shown by a white arrow in FIG. 7, a force acts on the restricting portion 15, in a normal direction of the restricting portion 15 of the upper mold 11 and outward with respect to the billet 2. As a result, a gap G between the pressing portion 13 and the groove portion 23 generated when the pressing portion 13 of the upper mold 11 and the groove portion 23 of the lower mold 21 are engaged can be reduced, and the material of the billet 2 can be suppressed from entering the gap G. As a result, the occurrence of burrs can be suppressed.

As described above, in the mold 1 and the forging method of the present embodiment, the material flow of the billet 2 can be guided toward both end portion of the billet 2 in the longitudinal direction by the groove portion 23 of the lower mold 21 and each guide portion 14, 24, 25, 26. Therefore, the material of the billet 2 can be satisfactorily flowed in the longitudinal direction of the billet 2.

Moreover, when each guide portion 14, 24, 25, 26 has a curved shape, the frictional resistance between each guide portion 14, 24, 25, 26 and the billet 2 when the billet 2 is extended can be reduced. Further, the internal pressure at an engaging portion of the pressing portion 13 of the upper mold 11 and the groove portion 23 of the lower mold 21 can be reduced. Therefore, it is possible to suppress the material of the billet 2 from entering the gap G between the pressing portion 13 and the groove portion 23, in which the gap G is generated when the pressing portion 13 of the upper mold 11 and the groove portion 23 of the lower mold 21 are engaged, and as a result, the generation of burrs can be suppressed.

Further, when the billet 2 is pressed, a force can be applied to the restricting portion 15, in the normal direction of the restricting portion 15 of the upper mold 11 and outward with respect to the billet 2. As a result, the gap G between the pressing portion 13 and the groove portion 23 generated when the pressing portion 13 of the upper mold 11 and the groove portion 23 of the lower mold 21 are engaged can be reduced, and the material of the billet 2 can be suppressed from entering the gap G. As a result, the occurrence of burrs can be suppressed.

Second Embodiment

Figure 8:
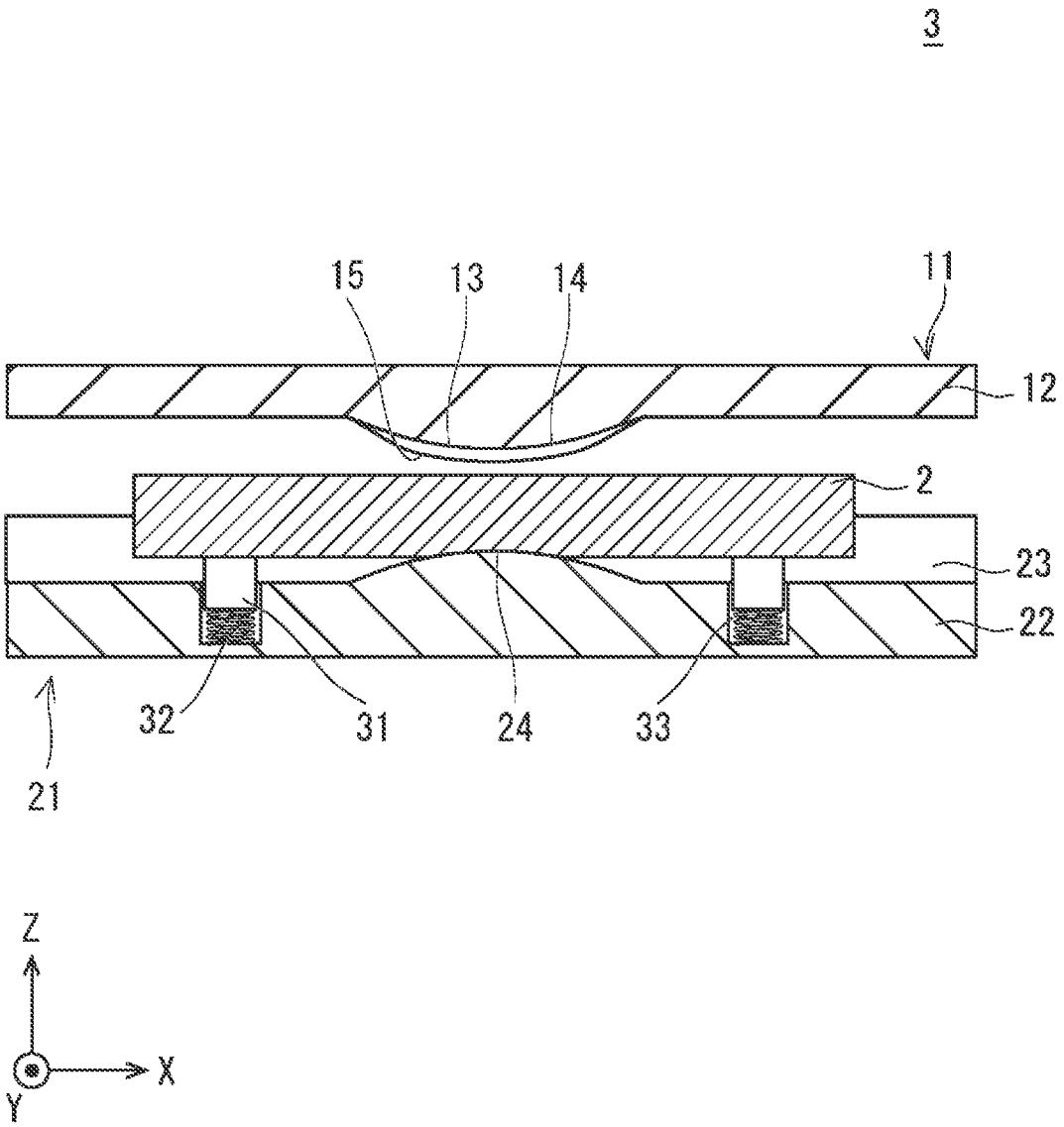
FIG. 8 is an XZ cross-sectional view schematically showing a state when the billet is forged using a mold of a second embodiment.
Figure 9:
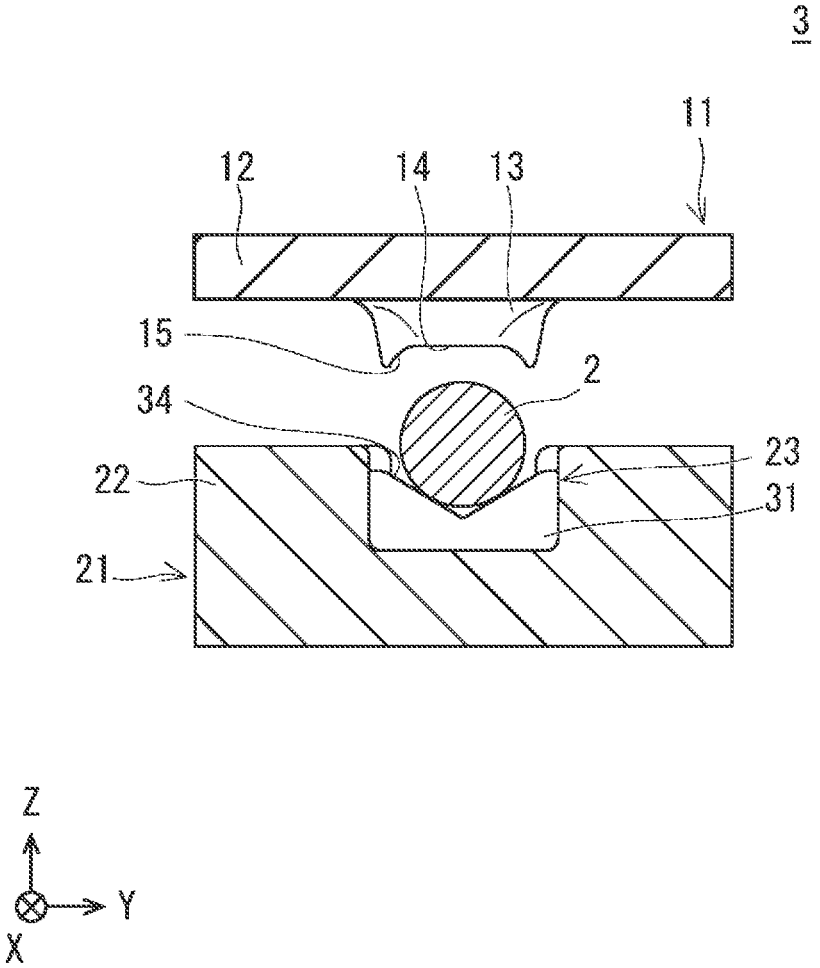
FIG. 9 is a YZ cross-sectional view schematically showing a state when the billet is forged using a mold of a second embodiment.
Figure 10:
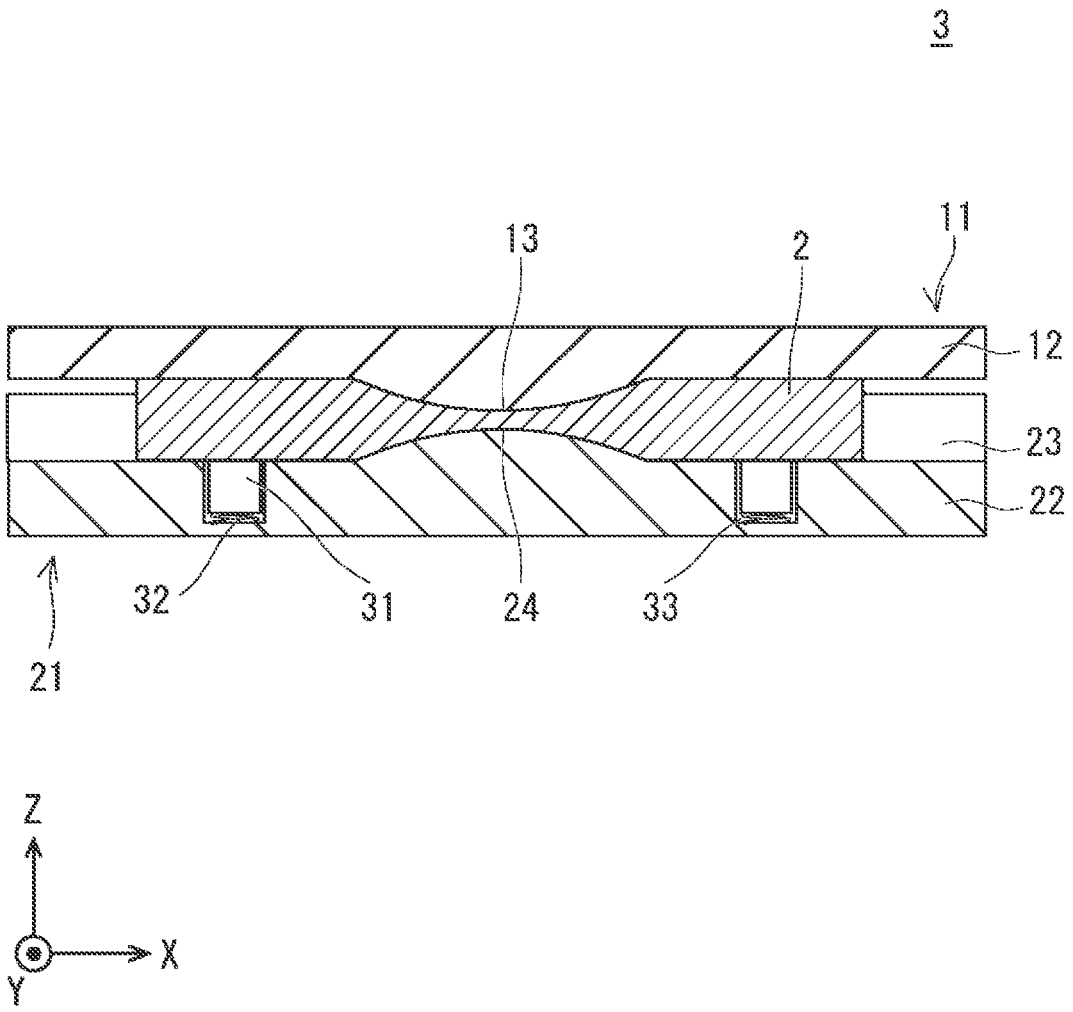
FIG. 10 is an XZ cross-sectional view schematically showing a state when the billet is forged using the mold of the second embodiment.

FIG. 8 is an XZ cross-sectional view schematically showing a state when the billet is forged using a mold of the present embodiment. FIG. 9 is a YZ cross-sectional view schematically showing a state when the billet is forged using the mold of the present embodiment. FIG. 10 is an XZ cross-sectional view schematically showing a state when the billet is forged using the mold of the present embodiment.

In addition to the configuration of the mold 1 of the first embodiment, a mold 3 of the present embodiment includes support portions 31 and elastic members 32 that support the billet 2 when the billet 2 is pressed. In the following description, the description overlapping with the first embodiment will be omitted, and the same members as the mold 1 of the first embodiment will be described by using the same reference numerals.

As shown in FIG. 8, the support portions 31 are disposed on both sides of the first guide portion 24 of the lower mold 21 in the X-axis direction, and are movable in the Z-axis direction. Specifically, inserted portions 33 are disposed at positions on both sides of the groove portion 23 of the lower mold 21 sandwiching the first guide portion 24 in the X-axis direction, and the support portions 31 are inserted into the inserted portions 33.

As shown in FIG. 9, each support portion 31 includes a mounting portion 34 on which the billet 2 is mounted at the end portion of the support portion 31 on the Z-axis plus side. The mounting portion 34 is a notch having a substantially V shape when viewed in the X-axis direction. However, the mounting portion 34 may have a shape that allows the billet 2 to be stably mounted.

Each elastic member 32 supports the support portion 31. The elastic member 32 is, for example, an elastic body such as a coil spring. The elastic member 32 is housed inside the inserted portion 33 of the lower mold 21, and is disposed between a bottom portion of the inserted portion 33 and the support portion 31. As a result, the elastic member 32 urges the support portion 31 toward the Z-axis plus side when the support portion 31 is pushed toward the Z-axis minus side.

When the billet 2 is housed in the groove portion 23 of the lower mold 21 in order to forge the billet 2 by using such a mold 3, the billet 2 is supported by the top portion of the first guide portion 24 of the lower mold 21 and the support portions 31 disposed on both sides with respect to the first guide portion 24.

Then, when the billet 2 is pressed by the pressing portion 13 of the upper mold 11 in order to forge the billet 2, the support portions 31 move to the Z-axis minus side as the billet 2 is pushed toward the Z-axis minus side. Finally, as shown in FIG. 10, the support portions 31 are housed in the inserted portions 33.

Since the billet 2 can be supported by the support portions 31 while the billet 2 is being pressed by the pressing portion 13 of the upper mold 11 in this way, the billet 2 can be stabilized when the billet 2 is pressed by the pressing portion 13 of the upper mold 11. Since the support portions 31 are urged to the Z-axis plus side by the elastic members 32, when the billet 2 is removed from the groove portion 23 of the lower mold 21, the support portions 31 can be returned to the state in which they are not pushed inside.

It suffices to adjust the elastic members 32 to have a urging force so that the elastic members 32 can stably support the billet 2 by the support portions 31 when the billet 2 is pressed by the pressing portion 13 of the upper mold 11, and so as not to interfere when pressing the billet 2 with the pressing portion 13 of the upper mold 11.

The present disclosure is not limited to the above embodiments, and can be appropriately modified without departing from the spirit thereof. In the above embodiment, the upper mold 11 and the lower mold 21 are provided with a guide portion, but it suffices to provide the upper mold 11 or the lower mold 21 with at least one guide portion.

What is claimed is:

1. A mold that is used when forging a billet having a rod shape, the mold comprising:

a lower mold having a groove portion for housing the billet;

an upper mold having a pressing portion that is engaged with the groove portion and that presses the billet; and a guide portion that is disposed in the groove portion or the pressing portion and that guides a flow of a material of the billet in a longitudinal direction of the billet, wherein in a state in which the groove portion and the pressing portion are engaged, in a direction in which the groove portion extends, a protruding amount of a top portion of the guide portion to an inner side of the groove portion is larger than a protruding amount of end portions on both sides sandwiching the top portion of the guide portion to the inner side of the groove portion, wherein the guide portion is disposed on a side portion or a bottom portion of the groove portion, and has a curved shape with a shape protruding inward of the groove portion, when viewed in a direction orthogonal to the direction in which the groove portion extends, and further comprising support portions that are disposed on both sides sandwiching the guide portion disposed on the bottom portion of the groove portion so as to be movable in a vertical direction of the mold, and that supports the billet housed in the groove portion.

2. The mold according to claim 1, wherein the guide portion is disposed at a lower end portion of the pressing portion, and has a curved shape with a shape protruding toward a lower side of the mold, when viewed in a direction orthogonal to the direction in which the groove portion extends in the state in which the pressing portion is engaged with the groove portion and when viewed in a direction orthogonal to a vertical direction of the mold.

3. The mold according to claim 1, wherein the support portions are supported by elastic members that expand and contract in the vertical direction of the mold.

4. A mold that is used when forging a billet having a rod shape, the mold comprising:

a lower mold having a groove portion for housing the billet;

an upper mold having a pressing portion that is engaged with the groove portion and that presses the billet; and a guide portion that is disposed in the groove portion or the pressing portion and that guides a flow of a material of the billet in a longitudinal direction of the billet, wherein in a state in which the groove portion and the pressing portion are engaged, in a direction in which the groove portion extends, a protruding amount of a top portion of the guide portion to an inner side of the groove portion is larger than a protruding amount of end portions on both sides sandwiching the top portion of the guide portion to the inner side of the groove portion, further comprising a restricting portion that is disposed in the pressing portion and that restricts a flow of the material of the billet in a transverse direction of the billet, wherein in the state in which the groove portion and the pressing portion are engaged, in the direction orthogonal to the direction in which the groove portion extends and in the direction orthogonal to the vertical direction of the mold, a protruding amount of both end portions of the restricting portion to a lower side of the mold is larger than a protruding amount of a top portion between the both end portions of the restricting portion to the lower side of the mold.

5. The mold according to claim 4, wherein the restricting portion has a curved shape with a shape protruding toward an upper side of the mold, when viewed in the direction in which the groove portion extends in the state in which the pressing portion is engaged with the groove portion.

6. The mold according to claim 4, wherein the guide portion is disposed at a lower end portion of the pressing portion, and has a curved shape with a shape protruding toward a lower side of the mold, when viewed in a direction orthogonal to the direction in which the groove portion extends in the state in which the pressing portion is engaged with the groove portion and when viewed in the direction orthogonal to the vertical direction of the mold.

7. A forging method that is a method of forging a billet having a rod shape, the method comprising:

a step of housing the billet in a groove portion of a lower mold; and a step of pressing the billet with a pressing portion of an upper mold and engaging the pressing portion to the groove portion;

wherein a flow of material of the billet to a longitudinal direction of the billet is guided toward both end portions of the billet by a guide portion disposed in the groove portion or the pressing portion, when the billet is pressed, wherein when the billet is pressed, portions on both sides of the billet sandwiching the guide portion are supported by support portions, wherein the support portions are disposed on both sides of the guide portion and disposed on the bottom portion of the groove portion so as to be movable in a vertical direction of the mold, and support the billet housed in the groove portion.

8. The forging method according to claim 7, wherein when the billet is pressed, a restricting portion that is disposed in the pressing portion restricts the flow of the material of the billet in a transverse direction of the billet.

* * * * *